US007549377B2

(12) United States Patent
Pabst

(10) Patent No.: US 7,549,377 B2
(45) Date of Patent: Jun. 23, 2009

(54) DAMPER FOR CABLEWAY TRACTION CABLES

(75) Inventor: Otto Pabst, Maranza (IT)

(73) Assignee: High Technology Investments B.V., Leimuiden (NL)

( * ) Notice: Subject to any disclaimer, the term of this patent is extended or adjusted under 35 U.S.C. 154(b) by 169 days.

(21) Appl. No.: 10/574,791

(22) PCT Filed: Sep. 27, 2004

(86) PCT No.: PCT/IB2004/003141

§ 371 (c)(1),
(2), (4) Date: Mar. 22, 2007

(87) PCT Pub. No.: WO2005/032901

PCT Pub. Date: Apr. 14, 2005

(65) Prior Publication Data

US 2007/0169660 A1 Jul. 26, 2007

(30) Foreign Application Priority Data

Oct. 3, 2003 (IT) ..... BZ2003A0050

(51) Int. Cl.
*B61B 7/00* (2006.01)

(52) U.S. Cl. ..... 104/180; 104/112; 104/196

(58) Field of Classification Search ..... 104/173.1, 104/178, 197, 199, 27, 28, 180, 196, 112
See application file for complete search history.

(56) References Cited

U.S. PATENT DOCUMENTS 3,170,412 A * 2/1965 Sowder ..... 104/173.2
3,934,517 A * 1/1976 Hirsig ..... 104/173.1
4,185,562 A * 1/1980 Hatori et al. ..... 105/152
4,280,411 A * 7/1981 Katayose et al. ..... 104/112
4,470,355 A * 9/1984 Kunczynski ..... 104/196
4,641,587 A * 2/1987 Dalliard ..... 105/3
5,107,771 A * 4/1992 Kainz ..... 105/149
5,113,768 A * 5/1992 Brown ..... 104/112

(Continued)

FOREIGN PATENT DOCUMENTS

AT 315 910 1/1973

(Continued)

*Primary Examiner*—S. Joseph Morano
*Assistant Examiner*—Jason C Smith
(74) *Attorney, Agent, or Firm*—K&L Gates LLP

(57) ABSTRACT

A damper is described for cableway traction cables comprising a carrying cable (2) stretched between a downstream station and an upstream station with a traction cable (3) returned by pulleys in the stations and at least one support (9) of the cables (2, 3) provided along the path of the cableway and bearing a support and a roller battery and a plurality of cabins (4) running along the carrying cables (2) and can be coupled with the traction cable (3) by means of clamps (6).

Figure 1:
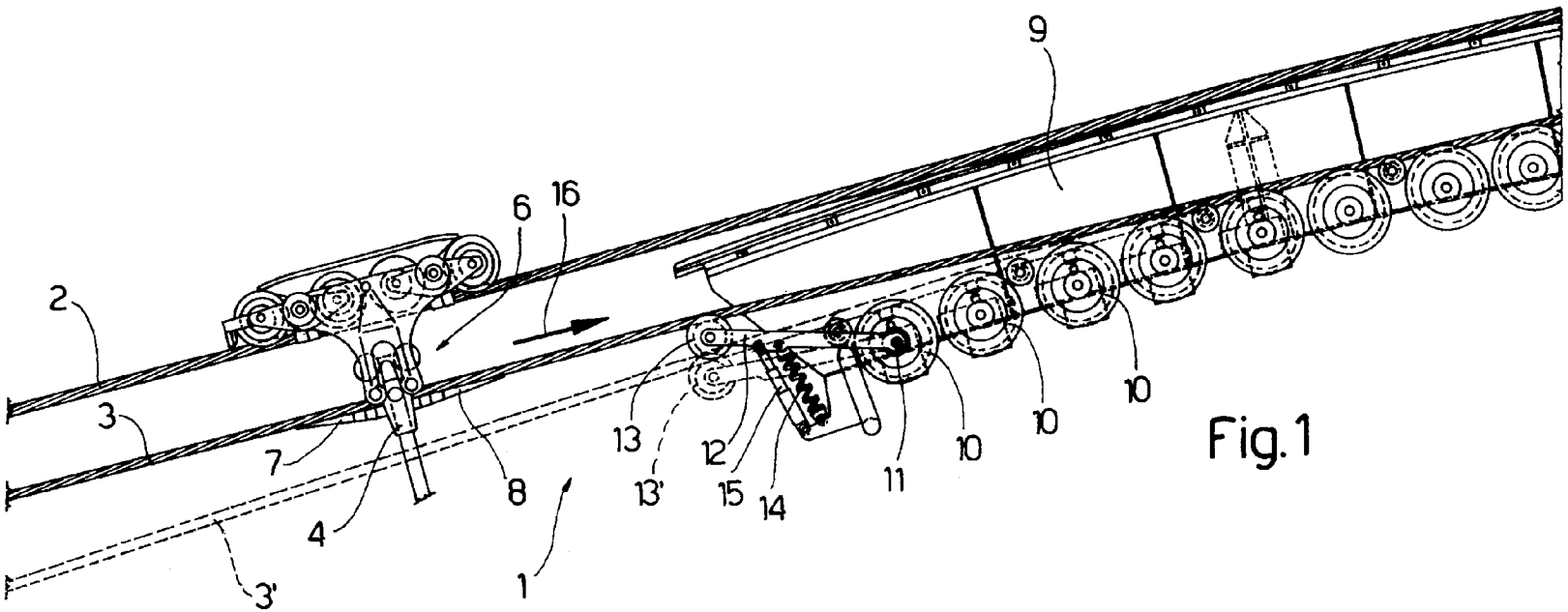

In accordance with this invention to the structure of the roller battery and preferably at the entrance of the roller battery in the direction of movement (16) of the cabins there is joined a lever (12) bearing at its free end a roller (13) engaged on the traction cable (3) and the lever is loaded by elastic means or weights towards the traction cable in such a manner as to soften the passage of this roller over the back of the clamp and to accompany the traction cable in the lowering onto the roller battery.

13 Claims, 2 Drawing Sheets

U.S. PATENT DOCUMENTS

| | | | | |
|---|---|---|---|---|
| 5,582,109 | A * | 12/1996 | Levi et al. | 104/173.1 |
| 2007/0169660 | A1 * | 7/2007 | Pabst | 104/196 |

FOREIGN PATENT DOCUMENTS

| | | | |
|---|---|---|---|
| AT | 342 655 | | 8/1977 |
| AT | 390 926 | | 1/1990 |
| EP | 0 640 518 | | 8/1994 |
| FR | 2670452 | A1 * | 6/1992 |

* cited by examiner

DAMPER FOR CABLEWAY TRACTION CABLES

This invention relates to a damper for cableway traction cables in accordance with the classifying part of claim 1. Cableways of this type comprise a carrying cable stretched between a downstream station and an upstream station and a continuously moving traction cable returned in the respective stations by a pulley of which one is the engine. On the carrying cable run the cars of the cabins hung on the cars through a suspension couplable with the traction cable through a clamp. The clamp itself in this case has a back on one of the jaws, which projects below the traction cable.

If between the downstream and upstream stations there are supports designed for supporting the carrying cable in its path through a support and the traction cable through a roller battery, there is the problem that the clamp upon passage of the car must raise the traction cable in order not to come into contact with the roller battery. Immediately after passage of the vehicle, the traction cable again rests on the roller battery of the support and the impact generates a wave, that is a slamming in the traction cable which spreads along the line while being reflected and increasing in amplitude upon approach of the vehicle especially when the crest of the spreading wave and the crest of the reflected wave are superimposed. It is easily imaginable that these waves create skipping and, in addition to being unpleasant for the passengers, they could cause an unacceptable movement of the traction cable.

The purpose of this invention is therefore to suppress or at least reduce the problem of wave generation while avoiding as much as possible slamming and skipping by proposing a damping and cushioning device designed to reduce as much as possible the wave formation origin.

This purpose is achieved in accordance with this invention in the characterizing part of claim 1.

Bending at the entrance of the roller battery a lever bearing at its other end a roller engaged on the traction cable, and loading the lever by elastic means or weights towards the traction cable, the back of the clamp or even the lock washer thereof, if any, is arranged more gently on this cushioned roller. Loading of this lever is chosen in such a way as to soften passage of this roller over the back of the clamp. In an improvement, the lever is loaded by a spring and cushioned by a shock absorber.

The shock absorber is preferably adjustable and is the pneumatic or hydraulic type.

In another example of realization, a two-armed lever of which one arm is joined at its free end to a support structure and supported by a compression spring as regards the roller battery, is associated with the lever joined to a roller, preferably in front of the first roller of the roller battery, while the other arm bears at its free end a guide running on the carrying cable with there being provided in the elbow of the two-armed lever a contrast medium suited to running on the lever joined to the first roller by lowering the lever to an optimal distance to allow the clamp to pass over this roller without interference.

In a variant, the guide of the second arm is made up of a grooved roller.

The contrast means is preferably a pin or a roller.

Figure 2:
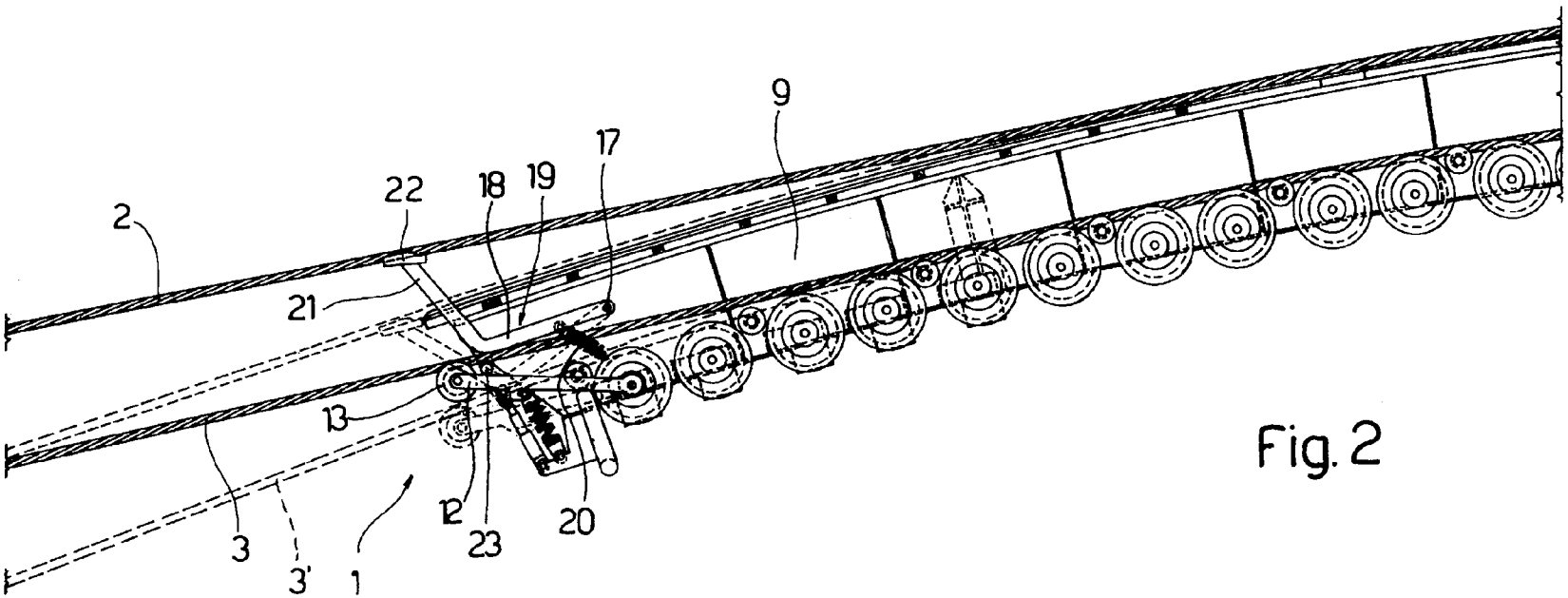

Further features and advantages of the cableway according to the invention will be apparent from the claims and the following description of two examples of preferred embodiments shown in the enclosed drawings, wherein:

FIG. 1 shows a side view of a detail of a cableway in accordance with this invention, and FIG. 2 shows a detail of a cableway in side view.

With reference to the figures, reference number 1 designates a whole cableway. One of the two cables is a carrying cable 2 stretched between a station downstream and one upstream. The other cable is a traction cable 3 returned by respective pulleys of the downstream and upstream stations to run continuously.

Through a suspension 4 a cabin, not shown, the cabin is connected in a known manner with a car 5 running on the carrying cable.

The suspension 4 is fitted in a known manner with a clamp 6 designed to be coupled to the traction cable in a decouplable manner. The clamp 6 has a back 7 projecting below with or without a lock washer 8.

Between the downstream and upstream stations there is provided a plurality of supports (not shown) fitted with a support 9 for the carrying cable 2 and a roller battery 10 in which the traction cable runs.

In accordance with this invention at the first roller of the roller battery in the articulated joint 11 a lever 12 is engaged and bears at its free end a roller or groove 13 loaded by a spring 14 towards the traction cable and damped in its movement by a shock absorber 15.

With a support in an articulated joint 17 is engaged an arm 18 of an angled two-armed lever 19 which is loaded by means of a spring 20 so that the second arm 21 of the lever 19 is pressed through a guide 22 at the free end of the second arm on to the carrying cable.

The two-armed lever 19 is fitted at its elbow with a pin 23 designed to shift the lever 12 depending on the position of the carrying cable.

It is clear that numerous variants can be provided without gong beyond the protective scope.

Thus, for example, both the pin 23 and the guide 22 can be replaced respectively by a roller to reduce friction.

The invention claimed is:

1. A cableway system comprising:

a carrying cable extending between a downstream station and an upstream station;

a traction cable extending between the downstream station and the upstream station, the traction cable returned by at least two pulleys in the stations;

at least one support of the carrying cable and the traction cable provided along a path of a cableway, the at least one support including at least one roller battery;

a plurality of cabins running along the carrying cable, said plurality of cabins each coupleable with the traction cable using at least one clamp; and a damper including:

(i) a first lever having a first end and a second end, the first end of the first lever joined to the roller battery at an entrance of the roller battery in a direction of movement of the cabins, the second end of the first lever being a free end connected to a roller engageable with the traction cable, the first lever loaded by at least one selected from the group consisting of: an elastic member, a spring, and a weight to bias the roller toward the traction cable to soften a passage of the roller over the at least one clamp and to accompany the traction cable in a lowering onto the roller battery, the first lever dampened by a shock absorber selected from the group consisting of: a pneumatic shock absorber and a hydraulic shook absorber, and (ii) a second lever configured to co-act with the first lever, the second lever including:

(a) a first arm having a free end, the first arm joined at said free end to the at least one support, the first arm supported by a compression spring, (b) a second arm having a free end, the second arm including at said free end a guide runnable on the carrying cable, and (c) an elbow fitted with a contrast member configured to shift the first lever depending on the position of the carrying cable, said shift dampening a vibration of the traction cable.

2. The cableway system of claim 1, wherein the guide of the second arm of the second lever includes a grooved roller.

3. The cableway system of claim 1, wherein the contrast member of the second lever includes at least one selected from the group consisting of: a pin and a roller.

4. A cableway traction cable damper comprising:

a first lever having a body, said body including:

(i) a first end attachable to a roller battery of a support structure, the roller battery configured to support a traction cable extending between a downstream station and an upstream station, the support structure configured to support a carrying cable extending between the downstream station and the upstream station, and (ii) a second, free end;

a roller attached to the second, free end of the body of the first lever, said roller engageable with the traction cable;

a first biasing member selected from the group consisting of: an elastic member and a weight, said first biasing member configured to co-act with the body of the first lever to bias the roller attached to the second, free end of the body of the first lever toward the traction cable to enable the roller to engage the traction cable to soften passage of the roller over at least one clamp which is attachable to the traction cable;

a shock absorber connected to the body of the first lever and connectable to the roller battery, the shock absorber selected from the group consisting of: a pneumatic shock absorber and a hydraulic shock absorber, said shock absorber configured to dampen a movement of the first lever;

a second lever having a body, the body including:

(i) a first end configured to engage the carrying cable, and (ii) a second end configured to co-act with said first lever;

a second biasing member selected from the group consisting of: an elastic member and a weight, said second biasing member configured to bias the first end of the body of the second lever toward the carrying cable to enable the first end of the body of the second lever to engage the carrying cable; and a contrast member configured to co-act with the second lever to enable the second lever to shift a position of the first lever based on a position of the carrying cable.

5. The cableway traction cable damper of claim 4, wherein the first end of the body of the first lever is attachable to the roller battery at an entrance of the roller battery in a direction of movement of the traction cable.

6. The cableway traction cable damper of claim 4, wherein the elastic member includes a spring.

7. The cableway traction cable damper of claim 4, wherein the first biasing member is configured to co-act with the body of the first lever to bias the roller attached to the second, free end of the body of the first lever toward the traction cable to control a movement of the traction cable toward the roller battery.

8. The cableway traction cable damper of claim 4, wherein the contrast member includes at least one selected from the group consisting of: a pin and a roller fitted in an elbow formed by the first end of the second lever and the second end of the second lever.

9. A cableway traction cable damper comprising:

a first lever having a body, said body including:

(i) a first end attachable to a roller battery of a support structure, the roller battery configured to support a traction cable extending between a downstream station and an upstream station, the support structure configured to support a carrying cable extending between the downstream station and the upstream station, and (ii) a second, free end;

a roller attached to the second, free end of the body of the first lever, said roller engageable with the traction cable;

a first biasing member selected from the group consisting of: an elastic member and a weight, said first biasing member configured to co-act with the body of the first lever to bias the roller attached to the second, free end of the body of the first lever toward the traction cable to enable the roller to engage the traction cable to soften passage of the roller over at least one clamp which is attachable to the traction cable;

a shock absorber connected to the body of the first lever and connectable to the roller battery, the shock absorber selected from the group consisting of: a pneumatic shock absorber and a hydraulic shock absorber, said shock absorber configured to dampen a movement of the first lever;

a second lever having a body, the body including:

(i)a first end configured to engage the carrying cable, and (ii)a second end configured to co-act with said first lever;

a second biasing member configured to bias the first end of the body of the second lever toward the carrying cable to enable the first end of the body of the second lever to engage the carrying cable; and a contrast member configured to co-act with the second lever to enable the second lever to shift a position of the first lever based on a carrying cable position.

10. The cableway traction cable damper of claim 9, wherein the first end of the body of the first lever is attachable to the roller battery at an entrance of the roller battery in a direction of movement of the traction cable.

11. The cableway traction cable damper of claim 9, wherein the elastic member includes a spring.

12. The cableway traction cable damper of claim 9, wherein the first biasing member is configured to co-act with the body of the first lever to bias the roller of the second, free end of the body of the first lever toward the traction cable to control a movement of the traction cable toward the roller battery.

13. The cableway traction cable damper of claim 9, wherein the second end of the body of the second lever is attached to the first lever.

* * * * *